US006142210A

United States Patent [19]

Isoda

[11] Patent Number: 6,142,210

[45] Date of Patent: Nov. 7, 2000

[54] MULTILAYERED INTEGRAL TYPE CURTAIN

[75] Inventor: Norihiro Isoda, Fukui, Japan

[73] Assignee: Suntex, Ltd., Fukui Prefecture, Japan

[21] Appl. No.: 09/193,686

[22] Filed: Nov. 18, 1998

[30] Foreign Application Priority Data

Dec. 16, 1997 [JP] Japan ..... 9-011535

[51] Int. Cl.[7] ..... A47H 1/00

[52] U.S. Cl. ..... 160/124; 160/84.04; 160/330; 160/DIG. 7

[58] Field of Search ..... 160/84.04, 123, 160/124, 126, 179, 330, DIG. 7; 428/247, 212; 66/196, 202

[56] References Cited

U.S. PATENT DOCUMENTS

| | | | |
|---|---|---|---|
| 1,611,031 | 12/1926 | Henderson | 160/DIG. 7 X |
| 1,923,512 | 8/1933 | Stein | 160/DIG. 7 X |
| 3,236,290 | 2/1966 | Lueder | 160/DIG. 7 X |
| 4,188,991 | 2/1980 | Boyle | 160/124 |
| 4,391,865 | 7/1983 | Constance | 160/DIG. 7 X |
| 4,399,671 | 8/1983 | Henningsson | 66/196 |
| 4,582,109 | 4/1986 | Fairbanks | 160/DIG. 7 X |
| 5,070,924 | 12/1991 | Bateman | 160/124 |
| 5,393,598 | 2/1995 | Schlecker | 428/247 |
| 5,443,563 | 8/1995 | Hindel et al. | 160/DIG. 7 X |
| 5,662,147 | 9/1997 | Haiber | 160/DIG. 7 X |

*Primary Examiner*—Bruce A. Lev
*Attorney, Agent, or Firm*—Larson & Taylor PLC

[57] ABSTRACT

A multilayered integral curtain comprising a first layer of curtain made of a comparatively thick woven fabric material or the like, a second layer curtain made of a comparatively thin woven fabric material, and a third layer of a comparatively thin fabric material such as lace, said first to third payers of curtain being integrally fixed only at upper edges thereof and hung down from a single supporting member.

4 Claims, 2 Drawing Sheets

MULTILAYERED INTEGRAL TYPE CURTAIN

BACKGROUND OF THE INVENTION

Conventional curtains to be attached to a window side of a room are used solely for the specific purposes of providing an ornament for a room and obtaining an internal space of a room or securing privacy.

In ordinary practice, two curtain rails are employed and a single sheet of curtain made of a relatively thick woven fabric or the like is hung on the room side or the window side and another single sheet of curtain made of a relatively thin material such as a lace material is hung on the window side or the room side, so that they can be opened and closed in accordance with necessity. In a day time, the relatively thick curtain made of a woven fabric material or the like is pulled opposite sides of the window in order to permit sun light to enter the room and only the relatively thick curtain made of a lace material or the like is closed. At night, however, only the relatively thin curtain made of a lace material or the like is not good enough because the inside of the room can be seen from outside through the lace curtain under the effect of light of the room lamp. Therefore, it is necessary to close the relatively thick curtain made of a woven fabric material so that the inside of the room cannot be see from outside.

The curtain used in the manner as mentioned above is called "dual curtain". As mentioned above, it is necessary for such a dual curtain to employ two curtain rails and two sheets of different kind of relatively thick and thin curtain materials.

In case of a window provided with only one curtain rail by some reasons (for example, a limited space just enough for mounting only one curtain rail, an economical reason or the like), only one of the curtain sheets, either the relatively thick one or the thin one, is employed. In this case, it is impossible, unlike in the case of the dual curtain, to selectively use the relatively thick or thin curtain in accordance with necessity.

There is also another example of a conventional curtain formed by integrally attaching two layers of fabric materials together. In this example, a sheet of front curtain material (the fabric appeared to the room side) is attached with a sheet of back curtain material (the fabric appeared to the window side) so that light shieldability is enhanced. There is still another example of a conventional curtain formed by integrally attaching two layers of fabric materials together. In this example, two sheets of relatively thin curtain material each having a good light permeability are attached together so that the final curtain allows light to permeate therethrough but does not allow the inside of the room to be seen from outside.

In the above additional examples, both the front and back curtain material sheets are attached by stitching with lug portions on opposite sides and occasionally with skirt portions and the two sheets of front and back curtain material are usually used as one piece. However, since there are differences in kind of the starting yarn used in the two sheets of fabric material (front sheet and back sheet), weaving texture, amounts of finishing agents such as various kinds of resins at the time of processing, heat effect at the time of heat set, etc., the two sheets of fabric material are not always entirely equal in elasticity.

Accordingly, if those two sheets of fabric material are stitched at their lug portions at opposite sides thereof into an integral curtain, a contracting wrinkle and an expanding wrinkle tend to occur in use due to difference in elasticity between the front fabric material and the back fabric material, thus resulting in a poor appearance.

SUMMARY OF THE INVENTION

This invention relates to a multilayered integral type curtain applicable to a window or the like.

The first object of the present invention is to obtain a triple layered integral type curtain capable of satisfying the requirements of utility and ornament by fixing three sheets of different kind of curtain material only at their upper edges by means of stitching or the like, so that three different kinds of curtain can be used with a single curtain rail or a single curtain rod, whereby, a single or plural sheets of curtain having best suited material can be used depending on circumstance, or the integral type curtain as a whole can be opened in accordance with necessity.

The second object of the present invention is to obtain a double layered integral type curtain by fixing two sheets of front and back fabric material only at their upper portions with opposite side edges and skirt portions thereof being open, so that an occurrence of wrinkle can be prevented in use.

The above objects can be achieved by the construction of the above-mentioned multilayered integral type curtain according to the present invention. Specific embodiments of the present invention are exemplified in the accompanying drawings and in the detailed description of the invention to be described hereinafter. Any minor alternation and modification are included in the scope of the appended claims.

DETAILED DESCRIPTION OF THE INVENTION

Figure 1:
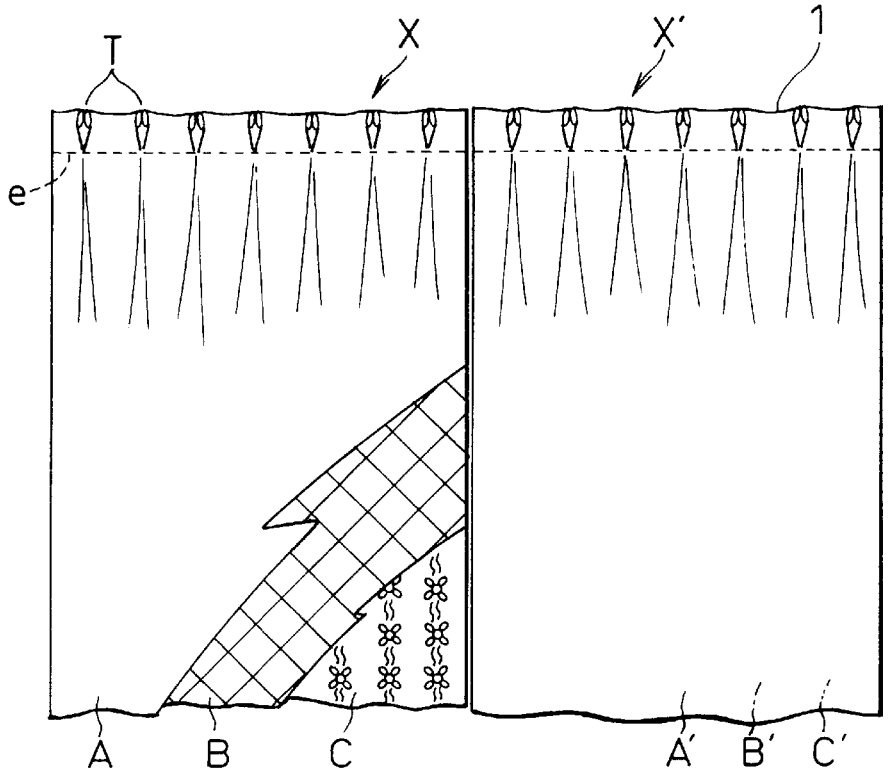
FIG. 1 is a view for explaining one embodiment of a triple layered integral type curtain according to the present invention.

As one embodiment of the present invention, FIG. 1 shows a triple layered integral type curtain including a left half portion (X) and a right half portion (X'). Those left and right half portions (X), (X') of the curtain each comprises a first layer of curtain (A), (A') made of a comparatively thick woven fabric material or the like, a second layer curtain (B), (B') made of a comparatively thin woven fabric material or the like and a third layer (C), (C') of a comparatively thin fabric material such as lace or the like. The first to third layers of curtain are fixed by stitching only at upper edges thereof to form an integral curtain assembly. There are provided a plurality of tucks (T) along a stitch line (e). Each tuck (T) is provided on a back side thereof with a hook not shown, so that the curtain can be hung on a single curtain rail or a single curtain rod.

Figure 2:
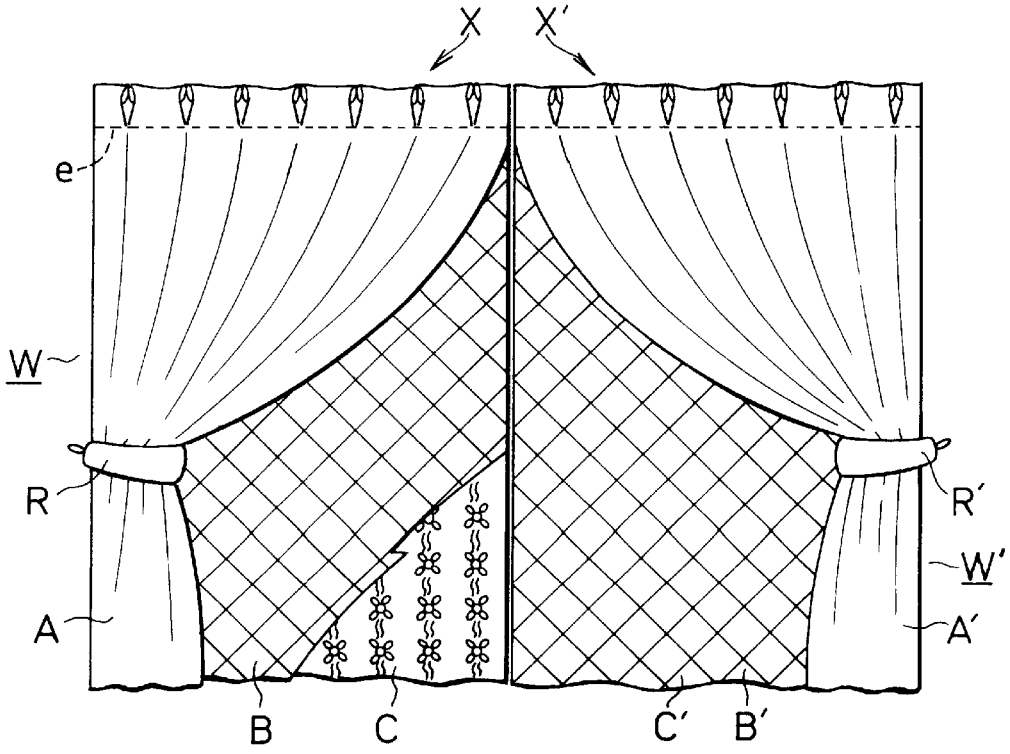
FIG. 2 is a view for explaining a state of use of the embodiment of FIG. 1.

FIG. 2 shows a state of use of the triple layered curtain (X), (X') of FIG. 1. That is, in a day time, the first layer of curtain (A), (A') made of a comparatively thick woven fabric material or the like is pulled to opposite sides (W), (W') of the window and retained by tassel bands (R), (R). At that time, the second layer curtain (B), (B') made of a comparatively thin woven fabric material or the like and the third layer (C), (C') of a comparatively thin fabric material such as lace or the like are in a closed position. In this state, a sufficient amount of light is allowed to enter the inside of the room from outside.

However, since the second layer curtain (B), (B') made of a comparatively thin woven fabric material or the like is closed in the above-mentioned state, the inside of the room cannot be seen from outside although a sufficient amount of light is allowed to enter the inside of the room from outside as previously mentioned. That is, although a reflecting light is allowed to enter the inside of the room in the above-mentioned state, a direct light proceeding straight ahead is restricted from passage through the curtain. This means that the ultraviolet ray and the infrared ray are also restricted from passage through the second layer curtain (B), (B') made of a comparatively thin woven fabric material or the like. In order to more efficiently achieve this purpose, the second layer curtain (B), (B') made of a comparatively thin woven fabric material or the like may be preliminarily fixedly impregnated with an ultraviolet ray absorbent agent and/or an infrared ray absorbent agent.

When sun light needs to be brought into the inside of the room from outside in a day time, second layer curtain (B), (B') made of a comparatively thin woven fabric material or the like is also pulled to the opposite sides (W), (W') of the window. That is, second layer curtain (B), (B') made of a comparatively thin woven fabric material or the like are also retained by tassel bands (R), (R') together with the first layer of curtain (A), (A') made of a comparatively thick woven fabric material or the like. In this way, there can be provided a multi-purpose triple layered integral type curtain (X), (X'), in which only the third layer (C), (C') of a comparatively thin fabric material such as lace or the like can be used, and when the first layer of curtain (A), (A') made of a comparatively thick woven fabric material or the like is closed, the outside cannot be seen from inside by the first layer of curtain (A), (A') and light can be restricted from passage through the curtain, with a single curtain rail or a single curtain rod. Moreover, since the triple layered integral type curtain (X), (X') are divided into two half portions at its central portion, the entire triple layered integral type curtain (X), (X') can be fully opened simply by pulling the two half portions to the opposite sides of the window.

With the triple layered integral type curtain (X), (X') according to the present invention, the first layer of curtain (A), (A') is gathered sideways and retained in a day time so that light can be freely brought into the inside of the room, and the first layer of curtain (A), (A') is spread by releasing the tassel bands at night so that the inside of the room cannot be seen from outside, and in addition, light can be restricted from passage through the curtain, by selectively using one or two or whole of the first to third layers of curtain. By this, there can be provided a curtain directly coping with a new interior design satisfying the requirements of ornament, performance and utility in addition to its feature of depth.

Figure 3:
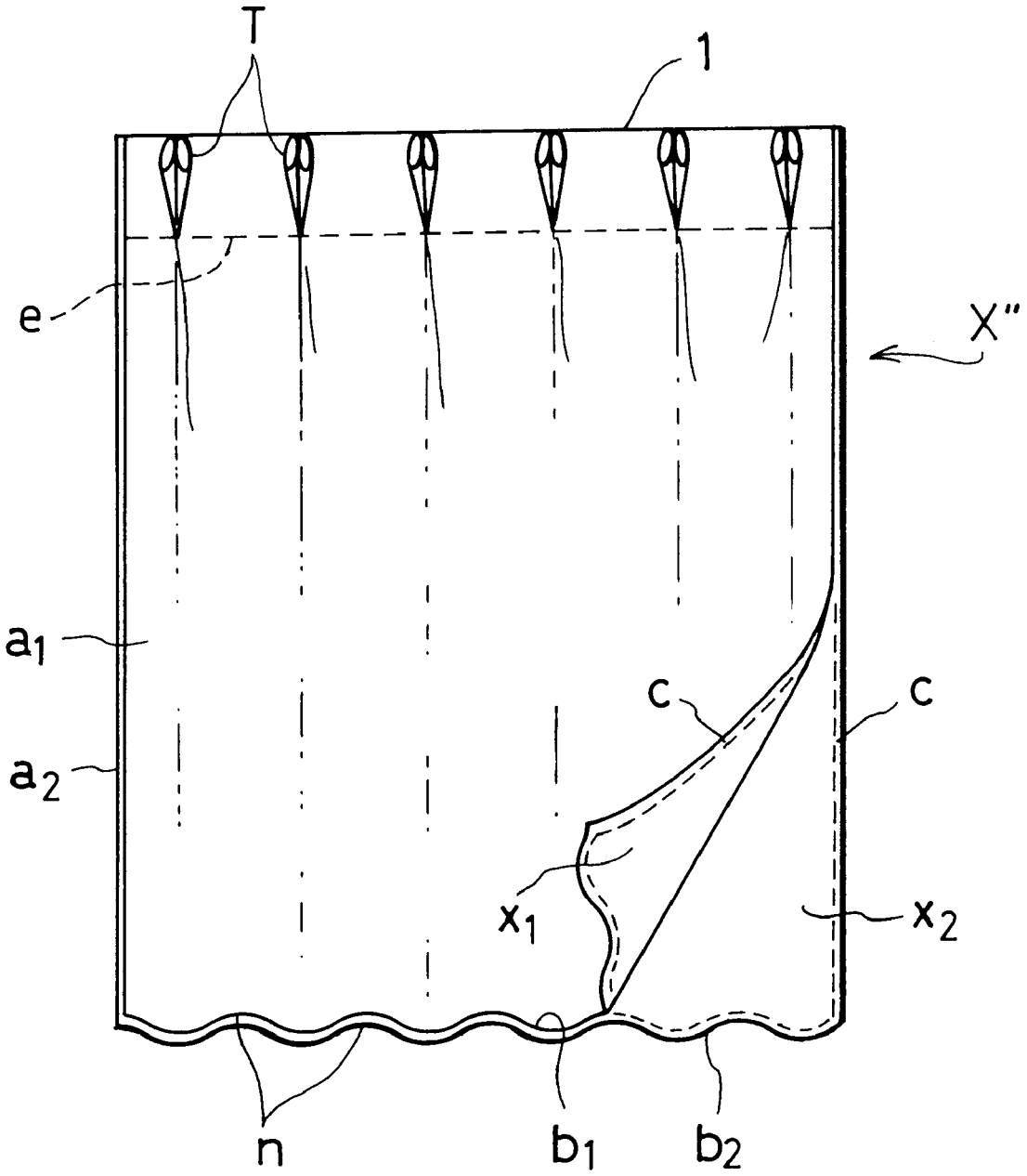
FIG. 3 is an explanatory view of a double layered curtain according to another embodiment of the present invention.

As the second embodiment of the present invention, there is provided a curtain (X") of FIG. 3 comprising a first and a second sheet of curtain material ($x_1$), ($x_2$) which are integrally fixed at an upper edge (1) of the curtain and provided with a plurality of tucks (T) at an upper edge area of the curtain. Lug portions ($a_1$), ($a_2$) at the opposite side edges and skirt portions ($b_1$), ($b_2$) are defined as a triple stitching portion (c) and are open. With such construction of a curtain, a back curtain fabric is attached to a front curtain fabric to form a double layered integral type curtain. In this way, the curtain as a double layered integral type is capable of enhancing shieldability of light. In addition, it can be used in such a manner as to allow passage of light but to make it difficult to see the inside of the room from outside by using the two layers of comparatively thin curtain fabric material each of which allows a good passage of light. In other words, this curtain exhibits a good light shielding and blocking performance. Moreover, an occurrence of wrinkle due to difference in expansion and contraction between the two sheets of curtain fabric material can be prevented.

This means that the present invention is applicable not only to the ordinary dual curtain using comparatively two sheets of thick and thin curtain fabric material but also to a double layered integral type curtain using a front fabric material and a back fabric material having vertically and horizontally different expansion and contraction which are conventionally supposed to be difficult to use for forming a dual curtain without any occurrence of wrinkle.

Moreover, by further provided with a wavy configuration (n) by holding the curtain (X") with a wavy form in a sandwiching manner and heat setting the same, there can be provided a first and a second sheet of curtain material ($x_1$), ($x_2$) in which valley portions and bump portions of the wavy configuration are in contact with each other, respectively, while allowing the area excluding the upper edge (1) to be free. Thus, this curtain can exhibit a stable configuration and performance as a double layered curtain.

In this way, there can be obtained a double layered curtain suitable as a room interior design.

It should be noted that the wavy configuration (n) can likewise be provided to the triple layered integral type curtain (X), (X') according to the first embodiment of the present invention in the same manner as in the curtain (X") according to the second embodiment.

What is claimed is:

1. A multilayered integral curtain having opposite sides and a skirt portion comprising:

first and second sheets of curtain, a fixline along only upper edges of said first and second sheets of curtain so that the first and second sheets of curtain are integrally fixed only at upper edges thereof, said fixline providing tucks therealong so that with said fixline the first and second sheets of curtain are adapted to be hung down from said integrally fixed upper edges by a single supporting member over an opening, thereby providing a multilayered integral curtain which allows both opposite side and skirt portions of the first and second sheets of curtain to be unfixed such that each said sheet is separable and openable to one side with respect to the other to thereby afford an adjustment of light passing through the opening.

2. A multilayered integral curtain according to claim 1, comprising two sheets of curtain which is further provided with a sinusoidal configuration, valley portions and bump portions of said sinusoidal configuration of each said sheet of curtain being in contact with each other to help provide a stable configuration of said integral curtain.

3. A multilayered integral curtain having opposite side edges and a skirt portion comprising:

a first layer curtain made of a thick woven fabric material, a second layer curtain made of a thin woven fabric material, a third layer curtain made of thin fabric material, and a fixline along only upper edges of said first, second and third layer curtains so that the first, second and third layer curtains are integrally fixed only at upper edges thereof, said fixline providing tucks therealong so that with said fixline the first, second and third layer curtains are adapted to be hung down from said integrally fixed upper edges by a single supporting member over an opening, thereby providing a multilayered integral curtain wherein both opposite edge sides and skirt portions of the first, second and third layer curtains are unfixed such that each said layer curtain is separable and openable to one side with respect to each other to thereby afford an adjustment of light passing through the opening.

4. A multilayered integral curtain according to claim 3, which is further provided with a sinusoidal configuration, valley portions and bump portions of said sinusoidal configuration of each said layer curtain being in contact with each other to help provide a stable configuration of said integral curtain.

* * * * *